US011161214B2

(12) United States Patent
Thompson

(10) Patent No.: US 11,161,214 B2
(45) Date of Patent: Nov. 2, 2021

(54) ELECTRODE SHARPENER COVER RETROFIT ATTACHMENT

(71) Applicant: Steven Thompson, Callaway, MD (US)

(72) Inventor: Steven Thompson, Callaway, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 537 days.

(21) Appl. No.: 16/265,209

(22) Filed: Feb. 1, 2019

(65) Prior Publication Data

US 2020/0246934 A1 Aug. 6, 2020

(51) Int. Cl.

| | |
|---|---|
| ***B24B 5/307*** | (2006.01) |
| ***B24B 5/22*** | (2006.01) |
| ***B24B 3/60*** | (2006.01) |
| ***B24B 41/06*** | (2012.01) |
| ***B24B 19/16*** | (2006.01) |
| ***B24D 15/06*** | (2006.01) |

(52) U.S. Cl.

CPC ..... *B24B 5/307* (2013.01); *B24B 3/60* (2013.01); *B24B 5/22* (2013.01); *B24B 19/16* (2013.01); *B24B 41/06* (2013.01); *B24B 41/066* (2013.01); *B24D 15/06* (2013.01)

(58) Field of Classification Search

CPC .... B24B 3/00; B24B 3/04; B24B 3/06; B24B 3/24; B24B 3/60; B24B 5/04; B24B 5/22; B24B 5/307; B24B 5/313; B24B 5/35; B24B 5/355; B24B 19/007; B24B 19/16; B24B 23/08; B24B 41/06; B24B 41/066; B24D 15/06

USPC ..... 451/344, 345, 346, 349, 391, 415, 451, 451/457

See application file for complete search history.

(56) References Cited

U.S. PATENT DOCUMENTS

| | | | | |
|---|---|---|---|---|
| 5,676,591 | A * | 10/1997 | Huang | B24B 3/265 451/349 |
| 6,106,372 | A * | 8/2000 | Clark | B24B 19/16 451/45 |
| 7,257,872 | B2 * | 8/2007 | Shim, II | B23K 11/3063 219/119 |
| 8,353,323 | B2 * | 1/2013 | Schumacher | B43L 23/02 144/28.1 |
| 9,227,289 | B2 * | 1/2016 | Tamm | B23K 11/3063 |
| 9,463,526 | B2 * | 10/2016 | Andersen | B24B 27/0084 |
| 9,796,068 | B2 * | 10/2017 | Jhones | B24D 18/00 |
| 2003/0013395 | A1 * | 1/2003 | Sakai | B23K 11/3063 451/453 |
| 2019/0285414 | A1 * | 9/2019 | Doeren | G01C 15/008 |

* cited by examiner

*Primary Examiner* — Eileen P Morgan
(74) *Attorney, Agent, or Firm* — Mark O. Glut; NAWCAD

(57) ABSTRACT

A sharpener cover retrofit attachment to retrofit an electrode sharpener cover attachment on an electrode sharpener, the electrode sharpener for sharpening an electrode rod and having a protruding hollow sharpener shaft with a sharpener shaft outer diameter and a rotating sharpener shaft inner diameter for accepting the electrode rod. The attachment includes a first and second annulus, both axially aligned such that they are able to accept and align the electrode rod into the rotating sharpener shaft inner diameter.

1 Claim, 3 Drawing Sheets

ELECTRODE SHARPENER COVER RETROFIT ATTACHMENT

STATEMENT OF GOVERNMENT INTEREST

The invention described herein may be manufactured and used by or for the Government of the United States of America for governmental purposes without payment of any royalties thereon or therefor.

BACKGROUND

Prior to use in a spectrometer, an electrode rod must be sharpened by electrode sharpener. Typically, an electrode sharpener includes a rotating sharpener shaft (typically a rotating electrode rod sharpener shaft inner diameter similar to a pencil sharpener) with a sharpener shaft inner diameter for accepting the electrode rod. When trying to sharpen an electrode rod, the rod is inserted into the sharpener shaft inner diameter d is then sharpened by the sharpener. Trying to align the electrode rod as it enters the rotating sharpening shaft results a high percentage of broken rods. Typically, if the electrode rod is not properly aligned it will snap and break as a result of the shaft gripping action. This increases costs and time.

SUMMARY

The present invention is di an electrode sharpener cover retrofit attachment that meets the needs listed above and below.

It is a feature of the present invention to provide an electrode sharpener cover retrofit attachment that aligns the electrode rod before entering the sharpener shaft and prevents electrode rods from breaking.

It is a feature of the present invention to provide an electrode sharpener cover retrofit attachment that aligns the electrode rod with an electrode sharpener.

It is a feature of the present invention to provide an electrode sharpener cover retrofit attachment that can be easily manufactured acid inexpensive to make and use.

DRAWINGS

These and other features, aspects, and advantages of the present invention become better understood with reference to the following description and appended claims, and accompanying drawings wherein:

DESCRIPTION

Figure 1:
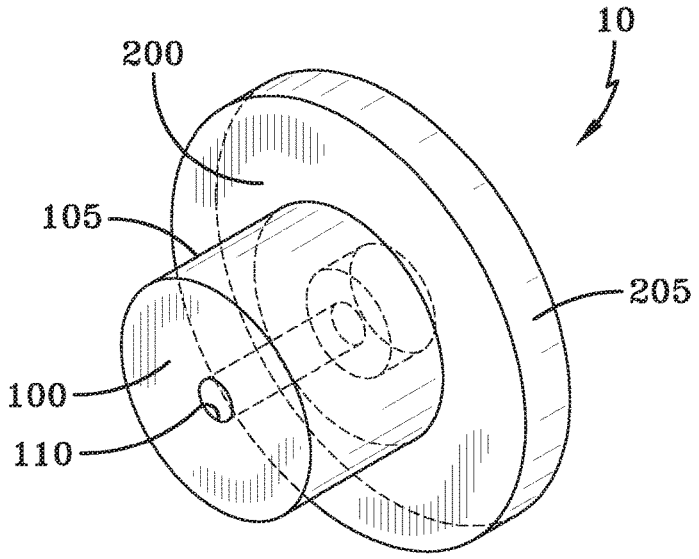
FIG. 1 is a top perspective view of an embodiment of the electrode sharpener cover retrofit attachment.
Figure 2A:
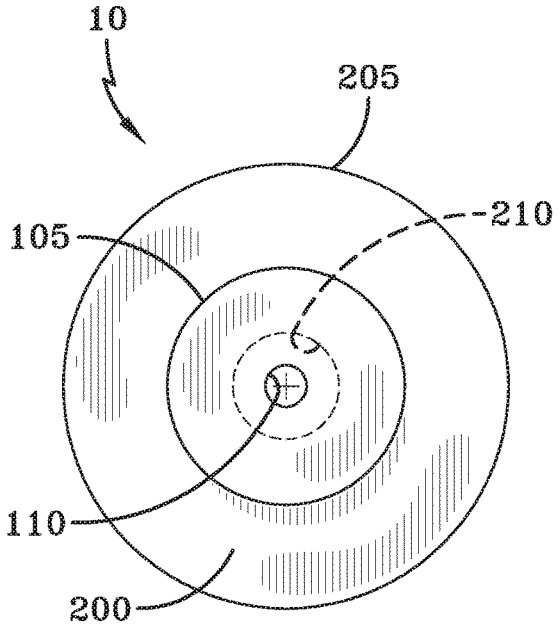
FIG. 2A is top view of an embodiment of the electrode sharpener cover retrofit attachment.
Figure 2B:
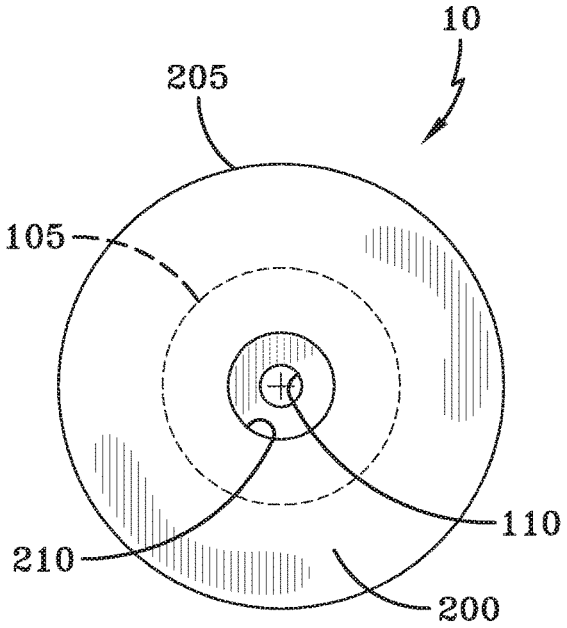
FIG. 2B is bottom view of an embodiment of the electrode sharpener cover retrofit attachment.
Figure 3:
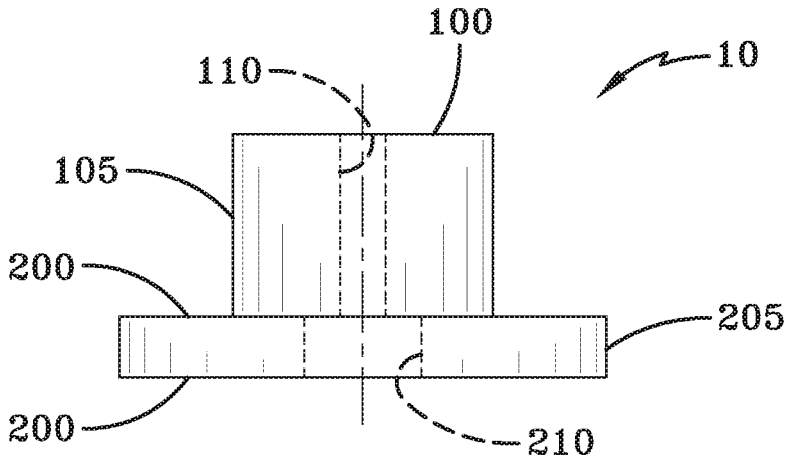
FIG. 3 is side s sectional view of an embodiment of the electrode sharpener cover retrofit attachment.
Figure 4:
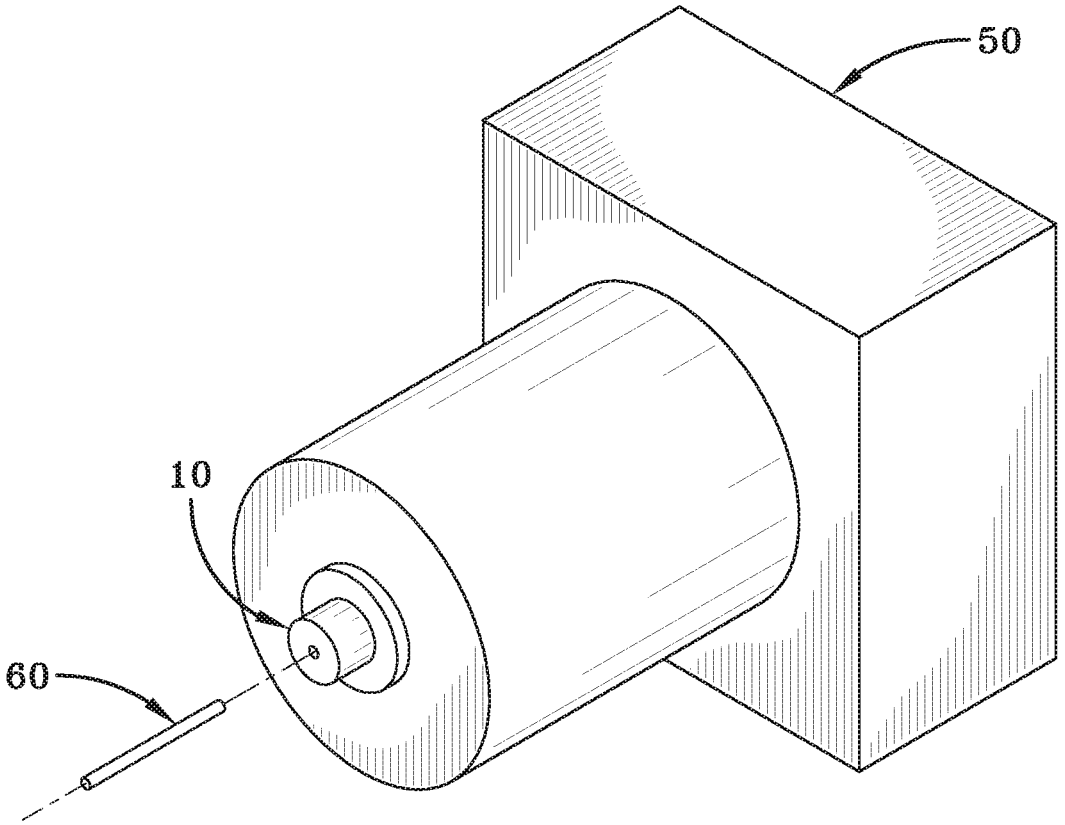
FIG. 4 is an embodiment of the electrode sharpener cover retrofit attachment attached to an electrode sharpener; and, FIG. 5 is cross sectional view an embodiment of the electrode sharpener cover retrofit attachment with an electrode sharpener.
Figure 5:
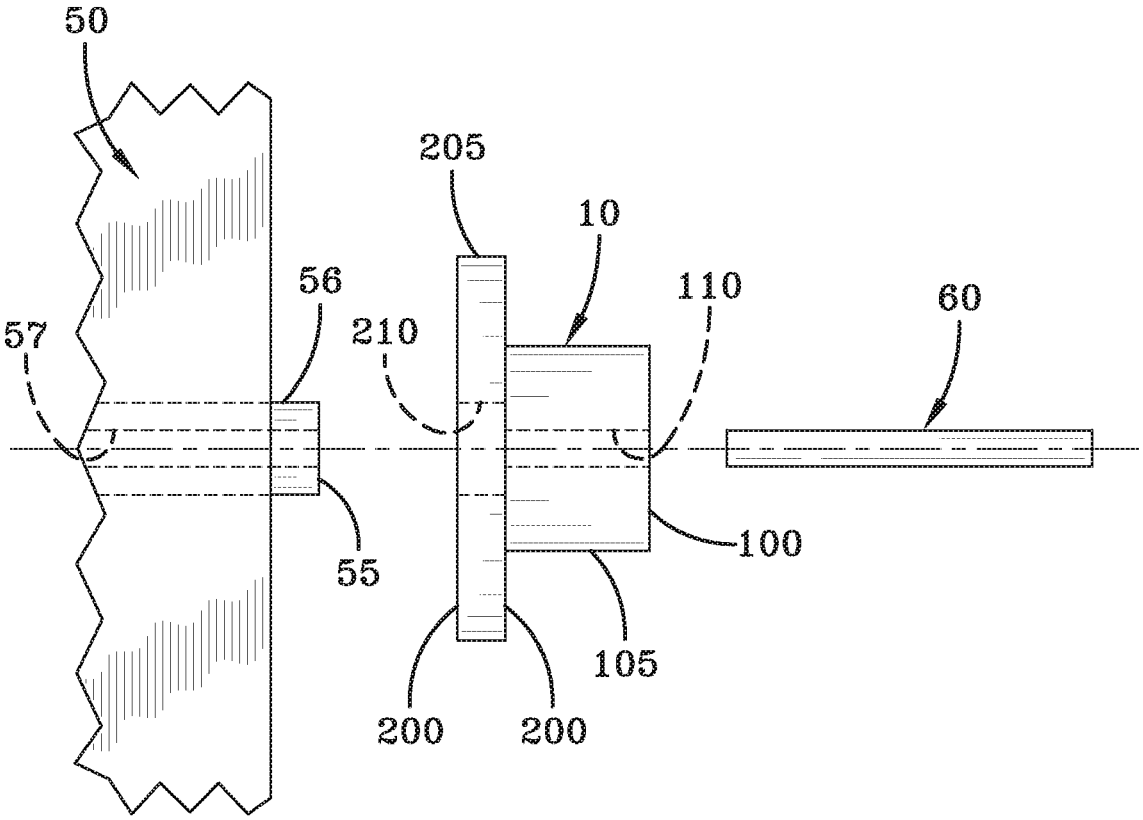

The preferred embodiments of the present invention are illustrated by way of example below and in FIGS. 1-5. The electrode sharpener cover retrofit attachment 10 for use on an electrode sharpener 50, is shown in FIGS. 1-5. As shown in FIG. 5, the electrode sharpener 50 for sharpening an electrode rod 60 has a protruding hollow sharpener shaft 55 with a sharpener shaft outer diameter 56 and a rotating sharpener shaft inner diameter 57 for accepting the electrode rod 60. The attachment 10 includes a first annulus 100 and a second annulus 200. The first annulus 100 includes a first annulus outer diameter 105 and a first annulus inner diameter 110. The first annulus inner diameter 105 is able to accept and align the electrode rod 60 with the rotating sharpener shaft inner diameter 57. The first annulus outer diameter 105 is larger than the sharpener shaft outer diameter 56, while the first annulus inner diameter 110 is smaller than the sharpener shaft outer diameter 56. The second annulus 200 has a second annulus outer diameter 205 and a second annulus inner diameter 210, with the second annulus outer diameter 205 being larger than the first annulus outer diameter 105. The first annulus inner diameter 110 is smaller than the second annulus inner diameter 210, and both are substantially axially aligned to each other and able to accept and align the electrode rod 60 into the first annulus inner diameter 110 and the rotating sharpener shaft inner diameter 57.

In the description of the present invention, the invention will be discussed in a military environment, particularly in a Navy Oil Analysis Program (NOAP) environment; however, this may be used in any environment.

In another embodiment of the invention, the first annulus 100 may include several annuli attached acting as a single annulus. The first annulus 100 may also be, but without limitation, several similar washers axially aligned. In yet another embodiment, the first annulus 100 can be replaced by a conical section (not shown) that includes a bore (acting as the first annulus inner diameter) disposed within the conical section. The attachment 10 may also be one piece of material and/or made via 3D printing or additive manufacturing.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred embodiments thereof, other embodiments are possible. Therefore, the spirit and scope of the appended claims should not be limited to the description of the preferred embodiment(s) contained herein.

What is claimed is:

1. An electrode sharpener cover retrofit attachment to retrofit an electrode sharpener cover attachment on an electrode sharpener, the electrode sharpener for sharpening an electrode rod having a protruding hollow sharpener shaft with a sharpener shaft outer diameter and a rotating sharpener shaft inner diameter for accepting the electrode rod, the electrode sharpener cover retrofit attachment comprising:

a first annulus with a first annulus outer diameter and a first annulus inner diameter, the first annulus inner diameter being able to accept and align the electrode rod with the rotating sharpener shaft inner diameter, the first annulus outer diameter being larger than the sharpener shaft outer diameter, the first annulus inner diameter being smaller than the sharpener shaft outer diameter;

a second annulus with a second annulus outer diameter and a second annulus inner diameter, the second annulus outer diameter being larger than the first annulus outer diameter, the second annulus inner diameter being larger than the first annulus inner diameter, the second annulus inner diameter being large enough to accept the protruding hollow sharpener shaft, the second annulus attached to the first annulus such that the first annulus inner diameter and the second annulus inner diameter are substantially axially aligned and the first annulus inner diameter and second annulus inner diameter are able to accept and align the electrode rod into the rotating sharpener shaft inner diameter.

* * * * *